US012467480B1

(12) United States Patent
Xiao

(10) Patent No.: US 12,467,480 B1
(45) Date of Patent: Nov. 11, 2025

(54) MULTIFUNCTIONAL OUTDOOR FAN

(71) Applicant: Wenlong Xiao, Lianjiang (CN)

(72) Inventor: Wenlong Xiao, Lianjiang (CN)

( * ) Notice: Subject to any disclaimer, the term of this patent is extended or adjusted under 35 U.S.C. 154(b) by 0 days.

(21) Appl. No.: 19/031,855

(22) Filed: Jan. 18, 2025

(30) Foreign Application Priority Data

Jan. 10, 2025 (CN) ..... 202520056779.2

(51) Int. Cl.

| | |
|---|---|
| ***F04D 29/70*** | (2006.01) |
| ***F04D 25/06*** | (2006.01) |
| ***F04D 25/10*** | (2006.01) |
| ***F04D 29/64*** | (2006.01) |

(52) U.S. Cl.
CPC ..... *F04D 29/705* (2013.01); *F04D 25/105* (2013.01); *F04D 29/703* (2013.01); *F04D 25/0673* (2013.01); *F04D 29/646* (2013.01)

(58) Field of Classification Search
CPC .. F04D 25/0673; F04D 25/105; F04D 29/646; F04D 29/703; F04D 29/705; F24F 6/12; F24F 6/14; F24F 2006/008
See application file for complete search history.

(56) References Cited

U.S. PATENT DOCUMENTS

| | | | | |
|---|---|---|---|---|
| 4,843,624 | A * | 6/1989 | Rashak | H04R 1/026 381/387 |
| 6,272,874 | B1 * | 8/2001 | Keeney | F04D 29/705 62/240 |
| 8,979,073 | B2 * | 3/2015 | Lykins | F04D 25/084 261/78.2 |
| 9,267,698 | B2 * | 2/2016 | Stearns | F24F 7/007 |
| 10,859,290 | B2 * | 12/2020 | Herweck | F24F 5/0017 |
| 2019/0242562 | A1 * | 8/2019 | Chien | F21V 23/023 |
| 2021/0372640 | A1 * | 12/2021 | Yang | F24F 13/20 |
| 2023/0118363 | A1 * | 4/2023 | Zhong | F04D 19/002 |
| 2023/0314032 | A1 * | 10/2023 | Yang | F24F 11/54 |

* cited by examiner

*Primary Examiner* — Nathaniel E Wiehe
*Assistant Examiner* — Jason G Davis
(74) *Attorney, Agent, or Firm* — JEEN IP LAW, LLC

(57) ABSTRACT

Disclosed is a multifunctional outdoor fan. The multifunctional outdoor fan includes a fan base, a fan support, and a fan head. The fan head is provided with a rotating shaft, fan blades mounted on the rotating shaft, and a fan grille mounted outside the fan blades. The fan grille is provided with a water tank, the water tank is provided with a water injection port, and the water injection port is connected to a water tank cover. The rotation shaft is provided with an atomization assembly, the atomization assembly is in communication with the water tank through a water tube, the water tank supplies water to the atomization assembly through the water tube, and the atomization assembly is provided with an atomization port.

9 Claims, 10 Drawing Sheets

MULTIFUNCTIONAL OUTDOOR FAN

CROSS REFERENCE TO RELATED APPLICATIONS

The present application claims the priority of Chinese patent application No. 202520056779.2, filed on Jan. 10, 2025, and contents of which are incorporated herein by reference.

TECHNICAL FIELD

The present disclosure relates to the field of electric fans, and particularly relates to a multifunctional outdoor fan.

BACKGROUND

A fan is an essential electrical appliance in summer's or hot summer's daily life. Air circulation around the fan can be accelerated by driving rotation of its fan blades. It is used to relieve summer heat and make people feel cool. However, an existing fan has a single function, which fails to satisfy needs of people today.

SUMMARY

To solve the above problems, examples of the present disclosure provide a multifunctional outdoor fan. The electric fan can shake its head and blow cool air in all directions, and achieve an effect of humidifying indoor air, thus satisfying blowing requirements of an entire room.

The present disclosure provides a multifunctional outdoor fan. The multifunctional outdoor fan includes a fan base, a fan support, and a fan head. The fan head is provided with a rotating shaft, fan blades mounted on the rotating shaft, and a fan grille mounted outside the fan blades.

The fan grille is provided with a water tank. The water tank is provided with a water injection port. The water injection port is connected to a water tank cover.

The rotation shaft is provided with an atomization assembly. The atomization assembly is in communication with the water tank through a water tube. The water tank supplies water to the atomization assembly through the water tube. The atomization assembly is provided with an atomization port.

The fan base is provided with a shaking motor, a printed circuit board (PCB), sound apparatuses, a battery, an audio playing assembly, and power input and output jacks. The battery is electrically connected to the shaking motor, the sound apparatuses, the PCB, the audio playing assembly, and the power input and output jacks.

In an example, a lamp panel is arranged around the atomization port. The lamp panel is provided with lamp beads. The lamp panel is annular. The lamp panel is provided with a matching transparent lampshade.

In an example, the sound apparatuses are symmetrically mounted at two opposite ends of the fan base. The sound apparatuses are provided with sound cavities and vibrating membranes. The vibrating membranes are provided with speaker grilles.

In an example, a bottom of the fan base is provided with an accommodating recess. The accommodating recess is internally provided with a foldable hook buckle.

In an example, the audio playing assembly includes a Bluetooth module and an audio amplification module. The audio playing assembly is electrically connected to the sound apparatuses. The Bluetooth module is electrically connected to the audio amplification module. The Bluetooth module transmits an audio signal in a wireless manner. The audio amplification module is configured to amplify a received audio signal. The audio signal is played through the sound apparatuses. In an example, the fan base is further provided with an accommodating bin. The accommodating bin is configured to place a remote controller of the fan.

In an example, the shaking motor is mounted on the fan base. The shaking motor is connected to the rotating shaft of the fan head. The fan head is fixed to a supporting frame having a U-shaped structure.

In an example, the power input and output jacks are provided with a dust-proof cover.

In an example, the fan base includes an upper housing and a lower housing. The PCB, the sound apparatuses, the battery and the audio playing assembly are located in a cavity formed by the upper housing and the lower housing. The upper housing is provided with a mounting port. The shaking motor penetrates the mounting port and is connected to the supporting frame of the fan head.

At least one technical solution used by the examples of the present disclosure can achieve the following beneficial effects:

1, The present disclosure can achieve a loudspeaker box function by arranging a plurality of speakers and the audio playing assembly (the Bluetooth module, an audio decoding module and the audio amplification module).

2, The present disclosure can achieve a shaking effect of the fan through the shaking motor.

3, In the present disclosure, clean water can be added into the water tank through the atomization assembly, such that indoor air can be humidified.

4, The present disclosure is provided with a remote controller and a remote controller accommodating cavity in a matching manner, and the remote controller is configured to control shaking, switching and timing of the fan, switching of gears and light, etc. In a case that the remote controller is not used, the remote controller may be put into the remote controller accommodating cavity.

5, By arranging the display screen, the present disclosure can display electric quantity information, time, etc. of the fan, such that a user can more intuitively check a working state of a host.

6, The present disclosure can also be used as a mobile power supply by arranging a power output mother seat, which is very convenient.

BRIEF DESCRIPTION OF THE DRAWINGS

The accompanying drawings, used to provide further understanding of the present disclosure, constitute part of the present disclosure, and illustrative examples of the present disclosure and their description serve to explain the present disclosure and are not to be construed as unduly limiting the present disclosure. In the drawings.

Figure 1:
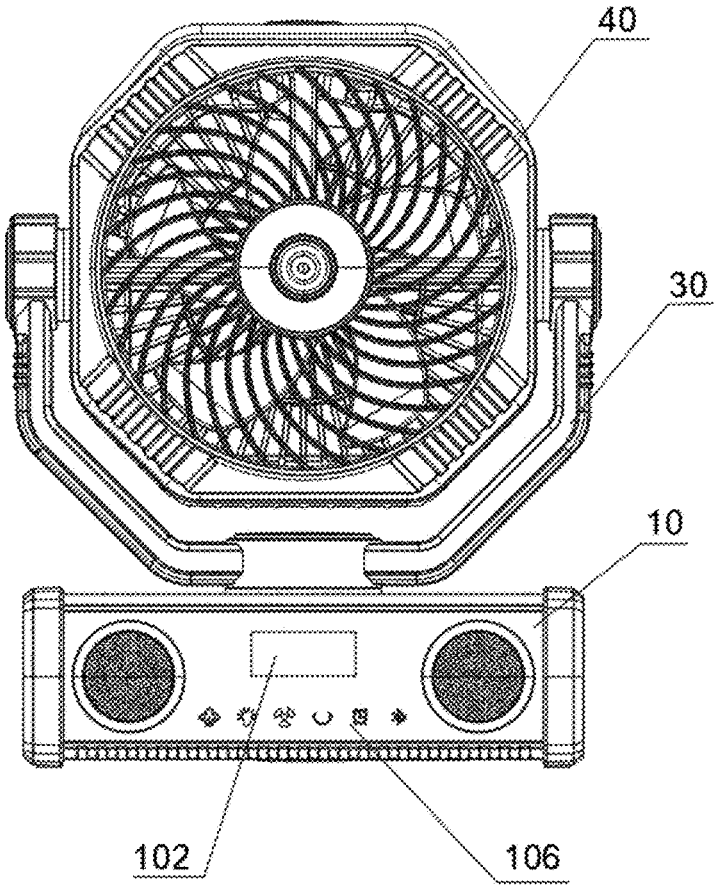
FIG. 1 is a front view (1) of a multifunctional electric fan of the present disclosure.

Reference numerals in the figures:

fan base 10, shaking motor 20, fan support 30, fan head 40, housing 100, printed circuit board (PCB) 101, display screen 102, remote controller 103, accommodating bin 104, battery 105, touch key zone 106, dust-proof cover 107, sound cavity 108, power input jack 109, power output jack 110, speaker grille 111, vibrating membrane 112, accommodating recess 113, foldable hook buckle 114, upper housing 115, lower housing 116, fan blade 402, water tank 403, water tank cover 404, atomization assembly 405, atomization port 406, lamp panel 407, transparent lampshade 408, water tube 409, and fan grille 410.

DETAILED DESCRIPTIONS OF THE EMBODIMENTS

For making objectives, technical solutions and advantages of the present disclosure clearer, the technical solutions of the present disclosure will be clearly and completely described below in conjunction with specific examples of the present disclosure and the corresponding accompanying drawings. Obviously, the examples described are merely some examples rather than all examples of the present disclosure. Based on the examples of the present disclosure, all other examples obtained by those of ordinary skill in the art without making creative efforts fall within the protection scope of the present disclosure.

The technical solutions provided by all the examples of the present disclosure will be described in detail below with reference to the accompanying drawings.

The present disclosure provides a multifunctional outdoor fan. As shown in FIGS. 1-10, the multifunctional outdoor fan includes: a fan base 10, a shaking motor 20, a fan support 30, and a fan head 40. The fan head 40 is provided with a rotating shaft, fan blades 402 mounted on the rotating shaft, and a fan grille 410 mounted outside the fan blades 402. The fan blades 402 are hinged to the rotating shaft through the rotating shaft. The fan grille 410 has a front grille and a rear grille. The rear grille is fixed to the fan support. The fan grille 410 encloses the fan blades 402. The shaking motor 20 is mounted on the fan base 10. The fan support 30 is a supporting frame having a U-shaped structure. The fan head 40 is fixed to the supporting frame having the U-shaped structure. The shaking motor 20 drives the fan head 40 to shake through a driving link.

Figure 3:
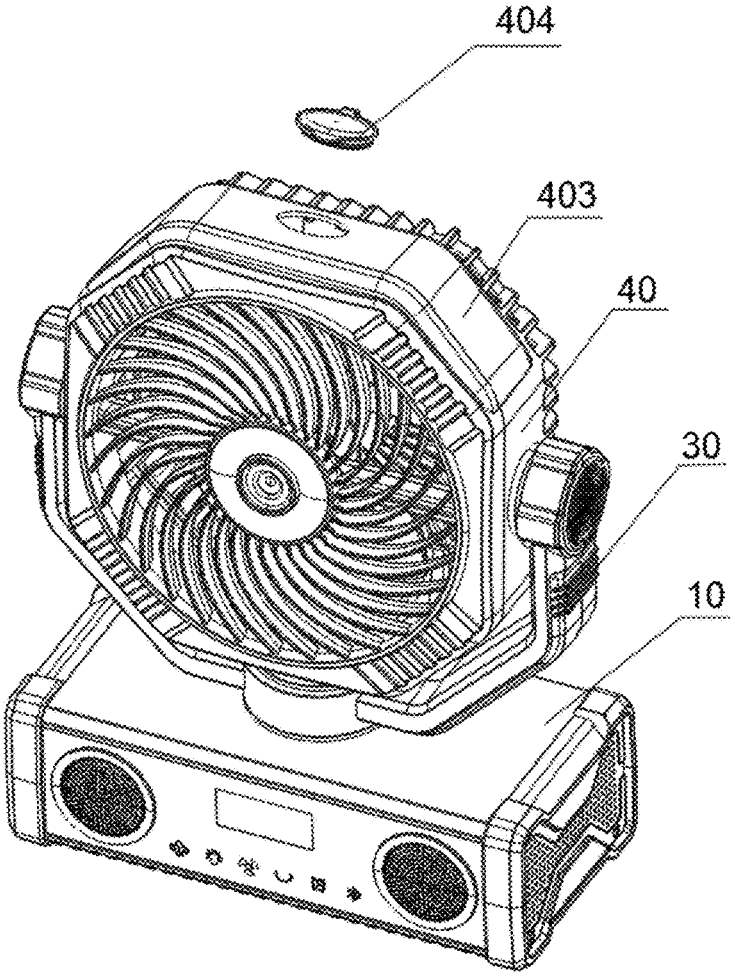
FIG. 3 is a front view (2) of a multifunctional electric fan of the present disclosure.

As shown in FIG. 3, the fan grille 410 is provided with a water tank 403. The water tank 403 is provided with a water injection port. The water injection port is connected to a water tank cover 404. The water tank 403 is arc-shaped and arranged in an arc direction of the fan grille 410. The water tank 403 is detachably connected to the fan grille 410, such that cleaning of the water tank 403 is facilitated. In a case that water needs to be injected into the water tank 403, the water injection port of the water tank is exposed by rotating the water tank cover 404, such that water may be injected into the water tank 403. After water injection, the water tank cover 404 is rotated, such that the water tank cover 404 covers a water injection end to prevent dust and impurities from falling into the water tank 403.

Figure 8:
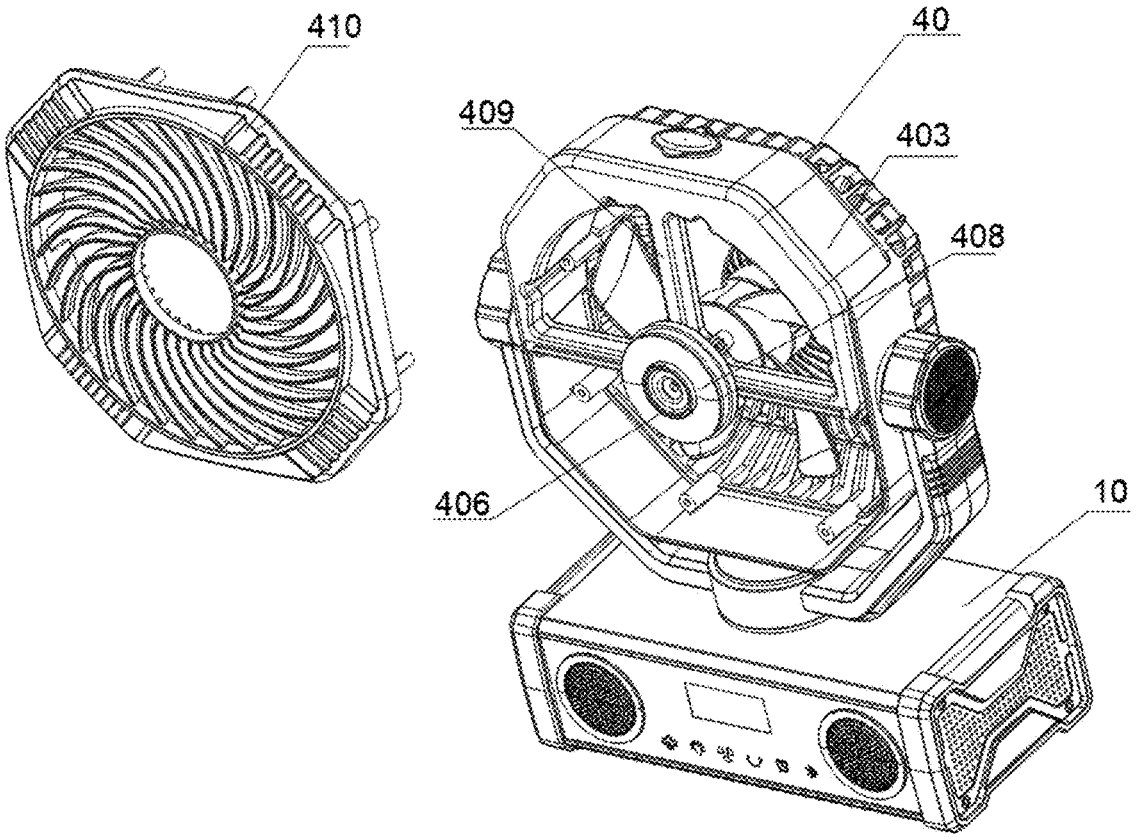
FIG. 8 is a schematic diagram (1) of an internal structure of a fan head of a multifunctional electric fan of the present disclosure.
Figure 9:
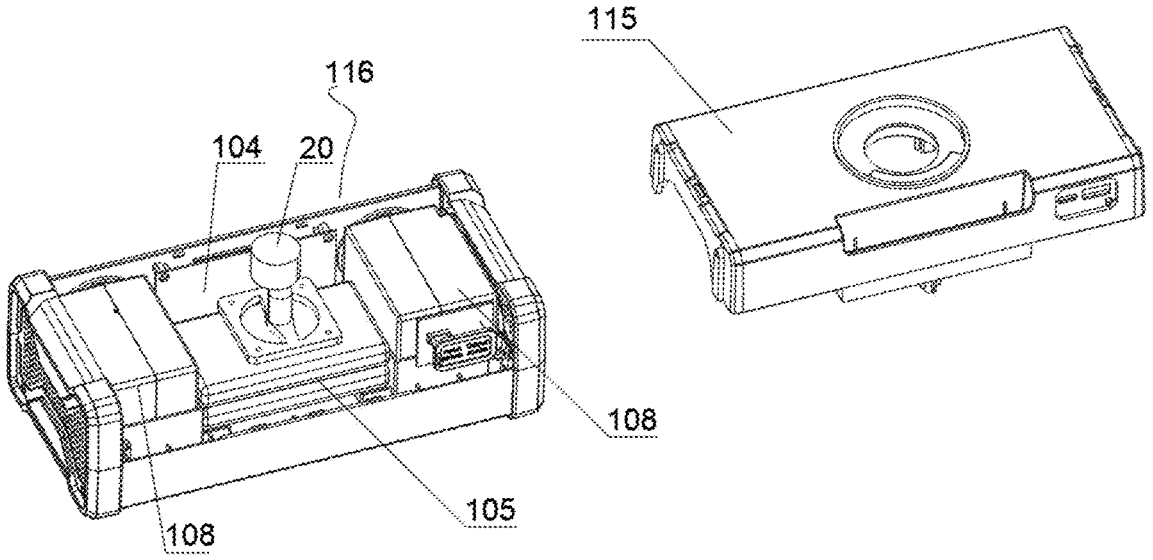
FIG. 9 is a schematic diagram (1) of an internal structure of a base of a multifunctional electric fan of the present disclosure.
Figure 10:
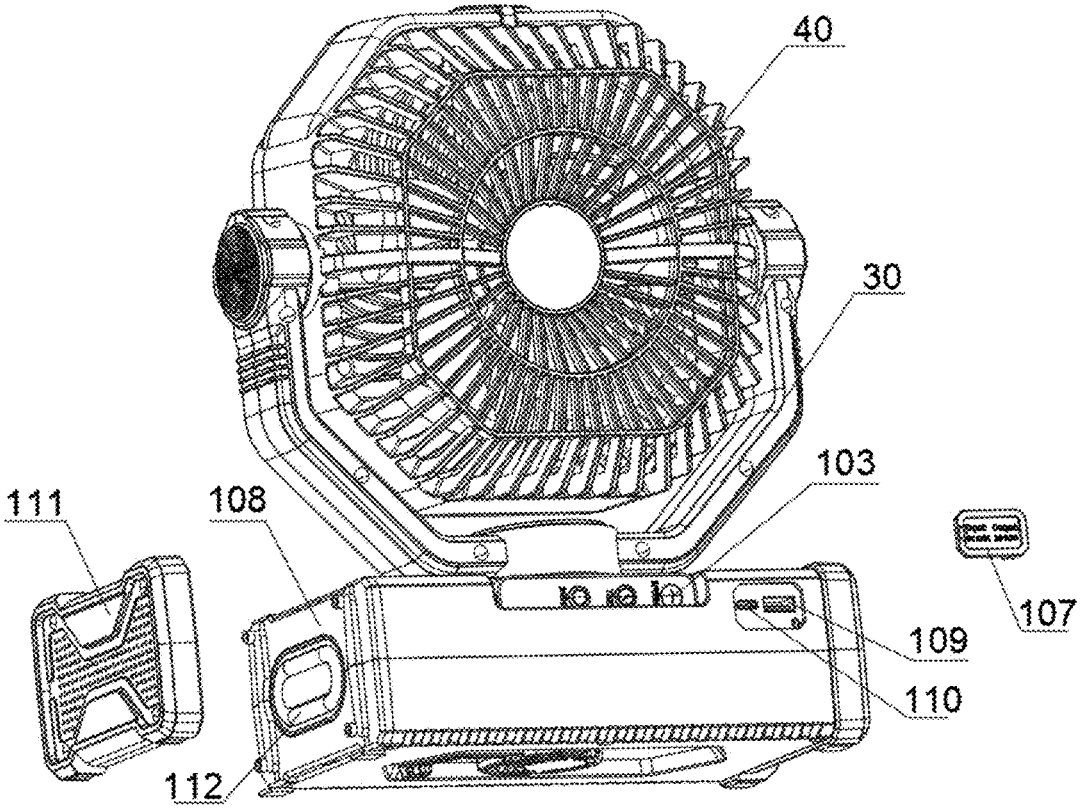
FIG. 10 is a schematic diagram (2) of an internal structure of a base of a multifunctional electric fan of the present disclosure.
Figure 11:
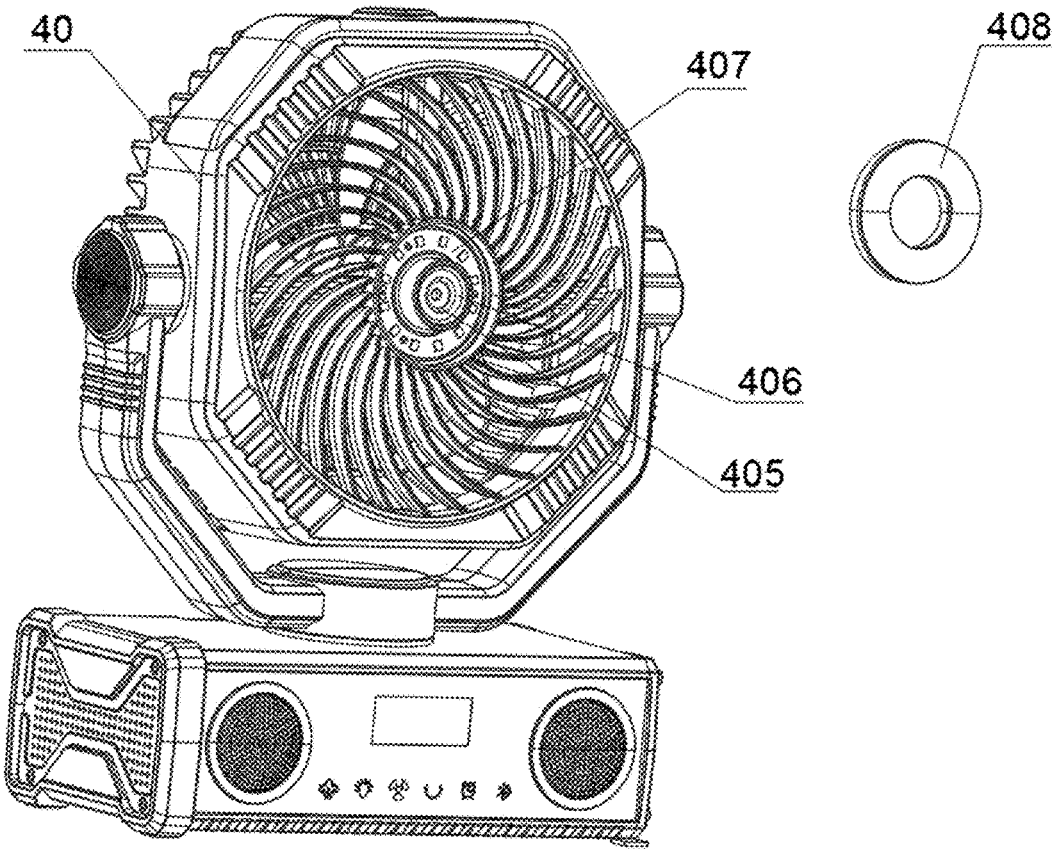
FIG. 11 is a schematic diagram (2) of an internal structure of a fan head of a multifunctional electric fan of the present disclosure.

As shown in FIGS. 8 and 11, the rotating shaft is provided with an atomization assembly 405, and the atomization assembly 405 is in communication with the water tank 403 through a water tube 409. The water tank 403 supplies water to the atomization assembly 405 through the water tube 409. The atomization assembly 405 is provided with an atomization port 406. A lamp panel 407 is arranged around the atomization port 406. The lamp panel 407 is provided with lamp beads for night lighting. The lamp panel 407 is annular. The lamp panel 407 is provided with a matching transparent lampshade 408. The transparent lampshade 408 is also annular.

As shown in FIGS. 8 and 11, the multifunctional fan is provided with the atomization assembly 405 on the fan head 40. In hot weather, an electric motor drives the fan to discharge wind so as to achieve a cooling effect. In hot and dry weather, a spraying and humidification function may be switched to. Water in the water tank 403 is atomized through an atomization module, and then mist is blown out through the water tube 409 and the atomization port 406 located on the rotating shaft, thus implementing organic combination of the atomization module and the fan.

As shown in FIG. 11, the lamp panel 407 is arranged around the atomization port 406. A lighting function may be selected in a dark environment. A light emitting diode (LED) lamp band mounted at an air outlet emits lights of several colors, and plays a lighting role without influencing normal operation of the functions. Thus, a user can identify a position and a surrounding environment, and further an appearance of a product is more attractive.

Figure 5:
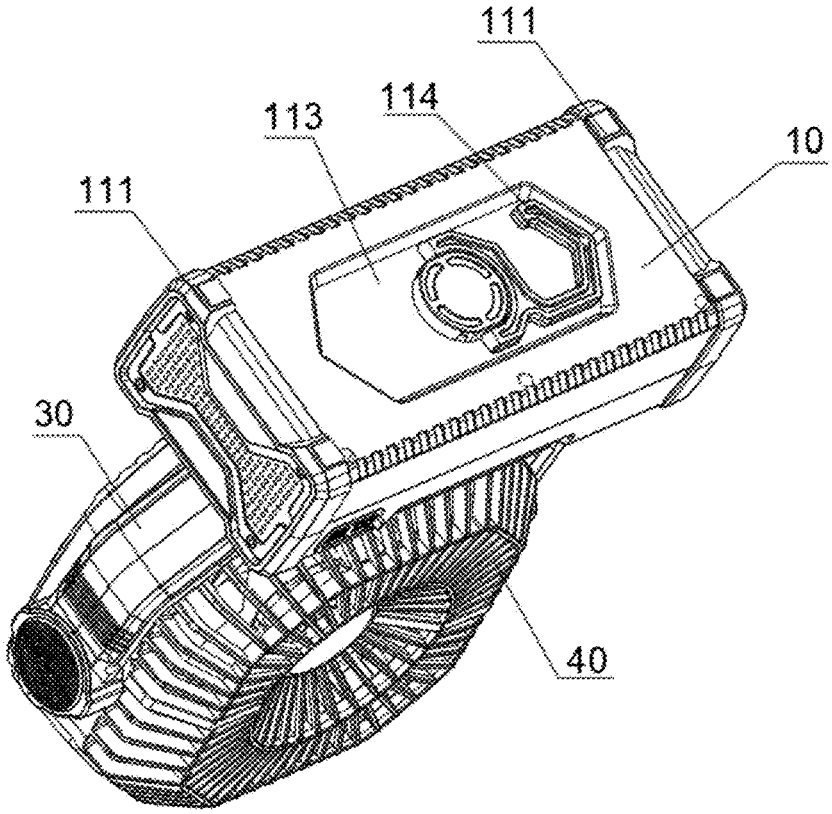
FIG. 5 is a bottom state view (1) of a base of a multifunctional electric fan of the present disclosure.
Figure 6:
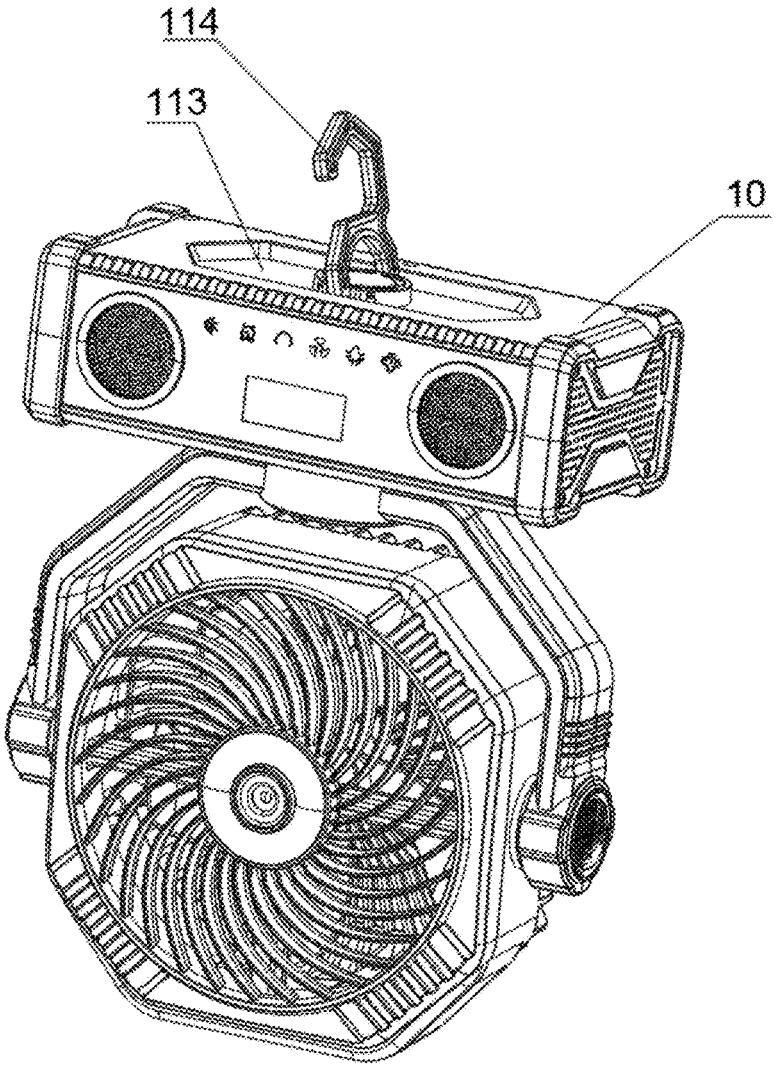
FIG. 6 is a bottom state view (2) of a base of a multifunctional electric fan of the present disclosure.
Figure 7:
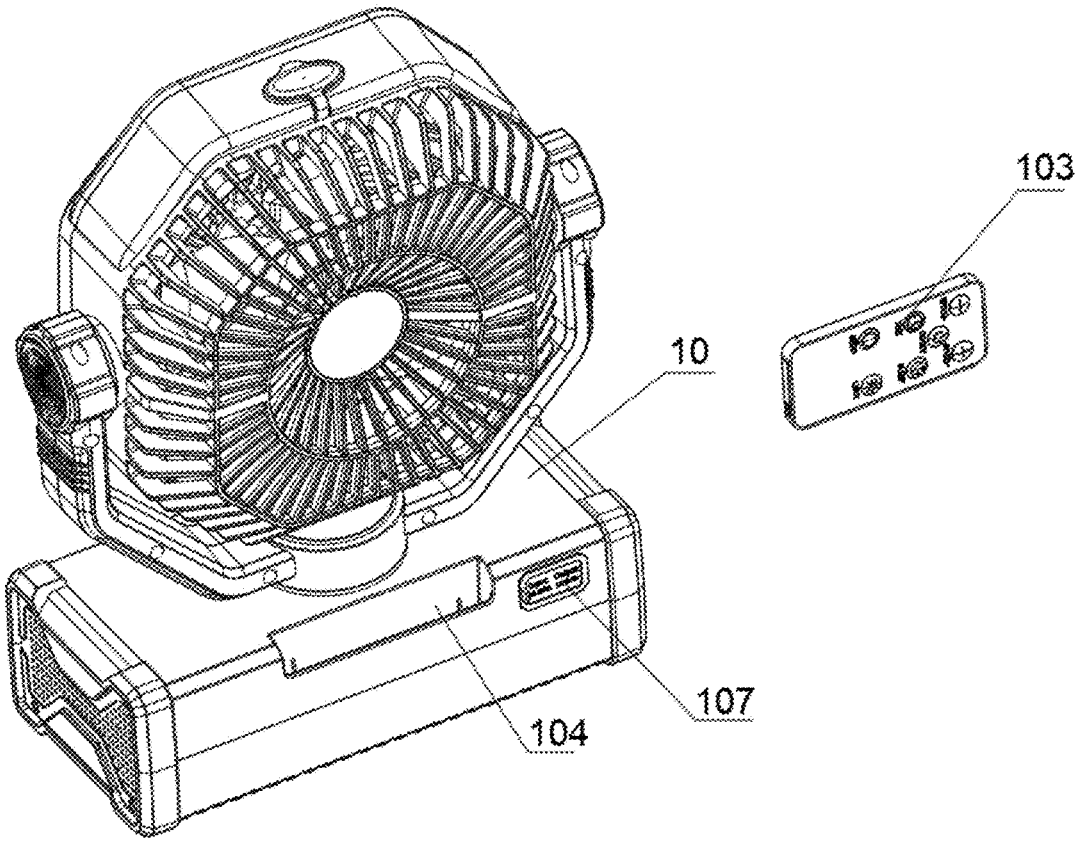
FIG. 7 is a rear view (2) of a multifunctional electric fan of the present disclosure.

As shown in FIG. 8, the fan base 10 is provided with the shaking motor 20, the PCB 101, sound apparatuses, a battery 105, an audio playing assembly, a power input jack 109, and a power output jack 110. The battery 105 is electrically connected to the shaking motor 20, the sound apparatuses, the PCB 101, the audio playing assembly, and the power input and output jacks. As shown in FIG. 5, the power input and output jacks are provided with a dust-proof cover 107. A bin for the battery 105 is provided in the fan base 10, and is configured to mount the battery 105.

In the present disclosure, the battery 105 is electrically connected to the power output jack, and the power output jack is used as a power output mother seat. It is very convenient to take power from a power supply by arranging the power output mother seat as a mobile power supply.

As shown in FIG. 8, the sound apparatuses are symmetrically mounted at two opposite ends of the fan base 10. The sound apparatuses are provided with sound cavities 108 and vibrating membranes 112. The vibrating membranes 112 are covered with speaker grilles 111.

The audio playing assembly includes a Bluetooth module and an audio amplification module. The audio playing assembly is electrically connected to the sound apparatuses. The Bluetooth module is electrically connected to the audio amplification module. The Bluetooth module transmits an audio signal in a wireless manner. The audio amplification module is configured to amplify a received audio signal. The audio signal is played through the sound apparatuses. As shown in FIG. 5, the fan base 10 is further provided with an accommodating bin 104. The accommodating bin 104 is configured to place a remote controller 103 of the fan.

As shown in FIGS. 8 and 11, one side of the fan base 10 is a display screen 102. The display screen is connected to the PCB 101, the audio playing assembly and the power supply. The display screen 102 has a touch key zone 106. Through operation in the touch key zone 106, use is more convenient and faster.

By arranging the display screen 102, the present disclosure can display electric quantity information, time, etc. of the fan, such that a user can more intuitively check a working state of a host.

Figure 2:
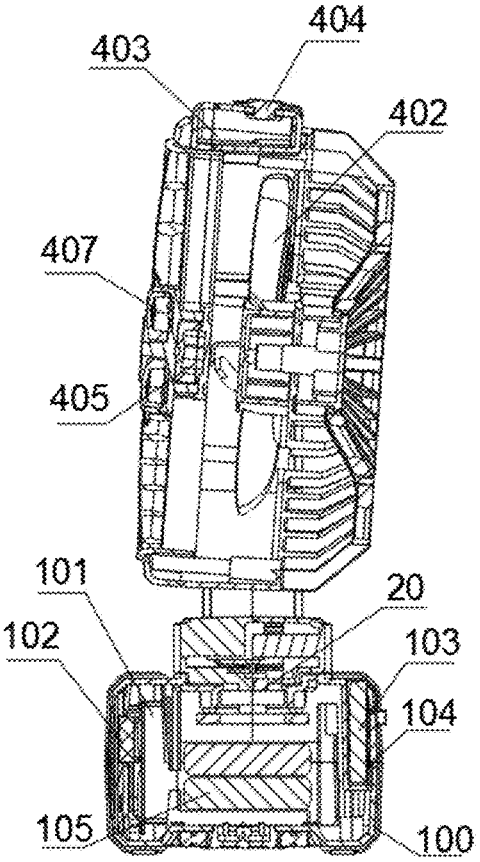
FIG. 2 is a cutaway view of FIG. 1.

As shown in FIG. 2, the fan base includes a housing 100. The housing 100 includes an upper housing 115 and a lower housing 116. The PCB 101, the sound apparatuses, the battery 105 and the audio playing assembly are located in a cavity formed by the upper housing 115 and the lower housing 116. The upper housing 115 is provided with a mounting port. The shaking motor 20 penetrates the mounting port and is connected to the supporting frame of the fan head 40.

Figure 4:
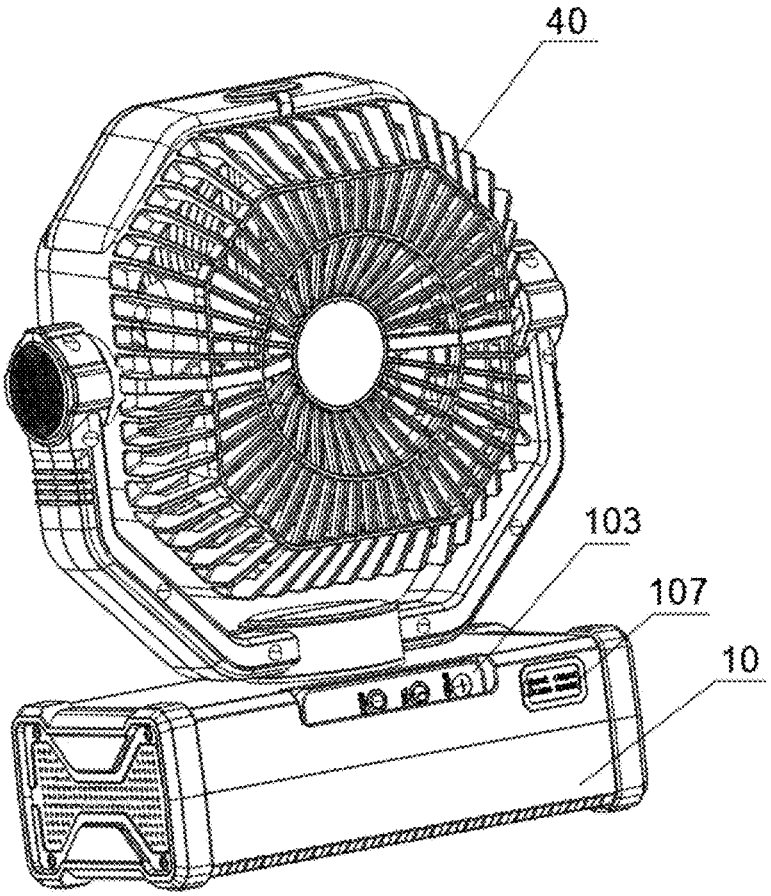
FIG. 4 is a rear view (1) of a multifunctional electric fan of the present disclosure.

As shown in FIGS. 3 and 5, in some examples, a bottom of the fan base 10 is provided with an accommodating recess 113. The accommodating recess 113 is internally provided with a foldable hook buckle 114. Specifically, as shown in FIG. 3, the foldable hook buckle 114 in a storage state is embedded in the accommodating recess 113. If the fan needs to be used upside down, as shown in FIG. 4, the foldable hook buckle 114 may be pulled out. If the fan is used as a desk fan, the foldable hook buckle 114 is accommodated in the accommodating recess 113. An operation of expanding and accommodating the foldable hook buckle is as intuitive and easy as an operation of opening and closing a ring. A user can easily complete the operation without special skills or tools, such that the fan can be switched between different use modes more conveniently.

An outer side of the base is provided with a universal serial bus (USB) interface. When a user needs to play music, an electronic apparatus may be connected through the USB interface, audio may be played, and the electronic apparatus may be charged. This structure not only facilitates daily use of users, but also improves entertainment and functionality of the electric fan.

Four corners of a bottom of the base are all provided with rubber suction cups. When the rubber suction cups make contact with a desktop, the base may be adsorbed onto a top of the desktop, thus improving stability of the electric fan.

The housing is further provided with control buttons configured to control sound volume, a power switch and Bluetooth connection. The control buttons are arranged on an outer side of the base.

The present disclosure has advantages:

1, The present disclosure can achieve a loudspeaker box function by arranging a plurality of speakers and the audio playing assembly (the Bluetooth module, an audio decoding module and the audio amplification module).

2, The present disclosure can achieve a shaking effect of the fan through the shaking motor.

3, In the present disclosure, clean water can be added into the water tank through the atomization assembly, such that indoor air can be humidified.

4, The present disclosure is provided with a remote controller and a remote controller accommodating cavity in a matching manner, and the remote controller is configured to control shaking, switching and timing of the fan, switching of gears and light, etc. In a case that the remote controller is not used, the remote controller may be put into the remote controller accommodating cavity.

5, By arranging the display screen, the present disclosure can display electric quantity information, time, etc. of the fan, such that a user can more intuitively check a working state of a host.

6, The present disclosure can also be used as a mobile power supply by arranging a power output mother seat, which is very convenient.

In the description of the present disclosure, it should be understood that orientations or positional relations indicated by the orientation terms "front, rear, upper, lower, left, and right", "transverse, vertical, and horizontal", "top and bottom", etc. are based on the orientations or positional relations shown in the accompanying drawings and are only for facilitating the description of the present disclosure and simplifying the description. Unless otherwise specified, the orientation terms do not indicate or imply that a device or element referred to must have a particular orientation or be constructed and operated in a particular orientation, and therefore cannot be interpreted as limiting the protection scope of the present disclosure.

For those skilled in the art, various other corresponding changes and variations can be made according to the technical solution and ideas described above, and all these changes and variations should be within the protection scope of the claims of the present disclosure.

What is claimed is:

1. A multifunctional outdoor fan, comprising a fan base, a fan support, and a fan head, wherein the fan head is provided with a rotating shaft, fan blades mounted on the rotating shaft, and a fan grille mounted outside the fan blades;

the fan grille is provided with a water tank, the water tank is provided with a water injection port, and the water injection port is connected to a water tank cover;

the fan head is provided with an atomization assembly, the atomization assembly is in communication with the water tank through a water tube, the water tank supplies water to the atomization assembly through the water tube, and the atomization assembly is provided with an atomization port; and the fan base is provided with a shaking motor, a printed circuit board (PCB), sound apparatuses, a battery, an audio playing assembly, and power input and output jacks, and the battery is electrically connected to the shaking motor, the sound apparatuses, the PCB, the audio playing assembly, and the power input and output jacks;

wherein a lamp panel is arranged around the atomization port, the lamp panel is provided with lamp beads, the lamp panel is annular, and the lamp panel is provided with a matching transparent lampshade.

2. The multifunctional outdoor fan according to claim 1, wherein the sound apparatuses are symmetrically mounted at two opposite ends of the fan base, the sound apparatuses are provided with sound cavities and vibrating membranes, and the vibrating membranes are provided with speaker grilles.

3. The multifunctional outdoor fan according to claim 1, wherein a bottom of the fan base is provided with an accommodating recess, and the accommodating recess is internally provided with a foldable hook buckle.

4. The multifunctional outdoor fan according to claim 1, wherein the audio playing assembly comprises a Bluetooth module and an audio amplification module, the audio playing assembly is electrically connected to the sound apparatuses, the Bluetooth module is electrically connected to the audio amplification module, the Bluetooth module transmits an audio signal in a wireless manner, the audio amplification module is configured to amplify a received audio signal, and the audio signal is played through the sound apparatuses.

5. The multifunctional outdoor fan according to claim 1, wherein the fan base is further provided with an accommodating bin, and the accommodating bin is configured to place a remote controller of the fan.

6. The multifunctional outdoor fan according to claim 1, wherein the shaking motor is mounted on the fan base, the shaking motor is connected to the rotating shaft of the fan head;

the fan head is fixed to the fan support, a and the fan support has a U-shaped structure.

7. The multifunctional outdoor fan according to claim 1, wherein the power input and output jacks are provided with a dust-proof cover.

8. The multifunctional outdoor fan according to claim 1, wherein the fan base comprises an upper housing and a lower housing;

the PCB, the sound apparatuses, the battery and the audio playing assembly are located in a cavity formed by the upper housing and the lower housing, the upper housing is provided with a mounting port, and the shaking motor penetrates the mounting port and is connected to the fan support of the fan head.

9. The multifunctional outdoor fan according to claim 1, further comprising a display screen, wherein the display screen is located at one side of the fan base and is connected to the PCB, the audio playing assembly and the battery, and the display screen is provided with a touch key zone;

wherein the battery is a power supply.

* * * * *